US011840878B2

(12) United States Patent
Liebscher et al.

(10) Patent No.: US 11,840,878 B2
(45) Date of Patent: Dec. 12, 2023

(54) PROFILE SYSTEM

(71) Applicant: DORMAKABA DEUTSCHLAND GMBH, Ennepetal (DE)

(72) Inventors: Arne Liebscher, Ennepetal (DE); Andreas Finke, Ennepetal (DE); Ralf Höher, Ennepetal (DE); Jens Klossas, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 150 days.

(21) Appl. No.: 17/424,076

(22) PCT Filed: Jan. 21, 2020

(86) PCT No.: PCT/EP2020/051431
§ 371 (c)(1),
(2) Date: Jul. 19, 2021

(87) PCT Pub. No.: WO2020/152180
PCT Pub. Date: Jul. 30, 2020

(65) Prior Publication Data

US 2022/0098924 A1 Mar. 31, 2022

(30) Foreign Application Priority Data

Jan. 21, 2019 (DE) ..... 10 2019 101 451.4

(51) Int. Cl.
*E06B 3/26* (2006.01)
*E06B 3/96* (2006.01)
(Continued)

(52) U.S. Cl.
CPC ..... *E06B 3/9687* (2013.01); *E06B 3/26305* (2013.01); *E06B 3/9642* (2013.01); *E06B 2003/2631* (2013.01)

(58) Field of Classification Search
CPC ..... E06B 3/26305; E06B 3/26301; E06B 3/9636; E06B 3/964; E06B 3/9642; E06B 3/9687; E06B 2003/2631
See application file for complete search history.

(56) References Cited

U.S. PATENT DOCUMENTS 2,941,855 A 6/1960 Weill
8,998,527 B2 * 4/2015 Clark ..... F16B 7/0473 403/231
(Continued)

FOREIGN PATENT DOCUMENTS

CN 115162917 A * 10/2022
DE 4308540 A1 9/1994
(Continued)

OTHER PUBLICATIONS

International Search Report dated Apr. 7, 2020 re: Application No. PCT/EP2020/051431, pp. 1-2, citing: U.S. Pat. No. 2015267460 A1 and EP 0829609 A2.

*Primary Examiner* — Ryan D Kwiecinski
(74) *Attorney, Agent, or Firm* — CANTOR COLBURN LLP

(57) ABSTRACT

A profile assembly includes two profile elements, a profile connecter element, and at least one fastening element connecting the two profile elements to each other using the profile connecter element. The first profile element includes guide channels for receiving two leg parts of the profile connecter element. The first profile element includes at least one fastening channel for receiving the fastening element. The second profile element includes a U-shaped recess for receiving the profile connecter element. In the base, the profile connecter element and second profile element in the bottom of the U-shaped recess thereof respectively include at least one mounting opening corresponding to the fastening channel for passing the fastening element there-through.
(Continued)

At least the second profile element is formed in several parts and includes two shell parts in the direction of interior and exterior rooms. The profile shell parts are connected to each other, yet thermally insulated.

10 Claims, 5 Drawing Sheets

(51) Int. Cl.

| | |
|---|---|
| ***E06B 3/968*** | (2006.01) |
| ***E06B 3/263*** | (2006.01) |
| ***E06B 3/964*** | (2006.01) |

(56) References Cited

U.S. PATENT DOCUMENTS

| | | | | |
|---|---|---|---|---|
| 9,086,083 | B2 * | 7/2015 | Hooper | F16B 12/50 |
| 9,127,504 | B2 * | 9/2015 | Sprague | E06B 3/70 |
| 11,131,140 | B2 * | 9/2021 | McKenna | E06B 3/06 |
| 11,180,947 | B2 * | 11/2021 | Alkarram | E06B 3/964 |
| 2015/0167712 | A1 * | 6/2015 | Clark | E06B 3/9642 29/897 |
| 2015/0267460 | A1 * | 9/2015 | Header | E06B 3/26303 52/204.5 |
| 2019/0119972 | A1 | 4/2019 | Weavers et al. | |

FOREIGN PATENT DOCUMENTS

| | | | | |
|---|---|---|---|---|
| DE | 102011008765 | A1 | 7/2012 | |
| DE | 102014115714 | A1 | 5/2016 | |
| EP | 0829609 | A2 | 3/1998 | |
| EP | 2088335 | A2 * | 8/2009 | E06B 3/972 |
| EP | 2088335 | A2 | 8/2009 | |
| EP | 2088337 | A2 * | 8/2009 | E06B 3/12 |
| EP | 2088337 | A2 | 8/2009 | |
| EP | 2453068 | A1 | 5/2012 | |

* cited by examiner

PROFILE SYSTEM

TECHNICAL FIELD

The present disclosure relates to a profile assembly, in particular for door systems for separating an interior room from an exterior room, comprising a first profile element formed as a horizontal profile, a second profile element formed as a vertical profile, a profile connecter element, which is formed U-shaped and which has two leg parts as well as a base part connecting the two leg parts at one end, as well as at least one fastening means for connecting to each other the two profile elements while using the profile connecter element. Extending in profile length direction, the first profile element has guiding channels, preferably for positively receiving both leg parts of the profile connecter element. Furthermore, the first profile element includes at least one fastening channel for non-positively or positively receiving the at least one fastening means. Seen in cross-section, the second profile element has a U-shaped recess for receiving areas of the profile connecter element. In the base part thereof, the profile connecter element and the second profile element in the bottom of the U-shaped recess thereof respectively include at least one mounting opening corresponding to the fastening channel of the first profile element and for passing the fastening means there through.

BACKGROUND

Various profile assemblies and corner connectors for profile assemblies are known in the state-of-the-art. A profile assembly according to the generic part of patent claim 1 is already known from EP 2 088 335 A2.

SUMMARY

The present disclosure provides a profile assembly, which, on the one hand, guarantees thermal separation between inner side and outer side of the profile elements of a profile frame, and which, on the other hand, excludes to the largest possible extent bending and warping of the profile frame or correspondingly counteracts the same.

This is achieved with all the features of the independent claim 1. Accordingly, this achieved by providing a profile assembly, in which, in further development, based on a generic profile assembly, at least the second profile element, formed as a vertical profile, is formed in several parts, and includes at least one first profile shell part, disposed in the direction of an interior room, and a second profile shell part, disposed in the direction of an exterior room, wherein the profile shell parts are connected to each other, thermally separated from each other, via at least one insulating element (e.g. insulating profile, or web). Furthermore, according to the disclosure, it is intended at least in the second profile element, via the insulating element itself or via the link of the insulating element to one of the two connected profile shell parts, to realize a thrust-flexible connection between the profile shell part disposed in the direction interior room and the profile shell part disposed in the direction exterior room, such that a relative displaceability in profile length direction is guaranteed between the two profile shell parts of the second profile element. According to the idea of the disclosure, is understood under thrust-flexible connection a connection with outer and inner profile shell parts, which are connected to each other via an insulating element (profile), in which the profile shell parts are displaceable opposite each other at maximum by medium manual force. For this purpose, a corresponding thrust-flexible connection is formed between one of the two shell parts and the insulating element (profile). Preferably, the connection between the other profile shell part and the separating element (profile) is formed thrust-rigid (namely not displaceable opposite each other).

The solution provides for a profile assembly—preferably with profile elements formed as aluminium profile—, which, based on temperature differences between interior room and exterior room, compensates for arising material tensions (which are caused by surface ratios primarily by the vertical profiles) and prohibits, to the largest extent, potential warping of the profile frame. In a profile assembly with profile elements from aluminium or the like, this allows for example the profile shell part of the vertical profile element disposed in the direction exterior room, upon warming (whereby the outer profile shell part differently warms with regard to the inner profile shell part), to have an essential unhindered expansion in profile length direction—in the vertical profile of a door leaf element, namely from top and bottom, as the outer shell herein is not "clamped" between top and bottom transversely extending screw connections, but can axially freely move with regard to, seen in cross-section, the back of the profile connecter element, which is disposed in the U-shaped formed reception of the second profile element (which for example also forms the glass channel for receiving a thermally insulating multiple glazing).

Preferred further developments of the disclosure are defined in the independent claims.

In a possible further development of the disclosure, the first profile element formed as a horizontal profile, is formed in multiple parts analogously (not identically) to the second profile element formed as a vertical profile, and includes at least one first profile shell part, disposed in the direction of an interior room, and a second profile shell part disposed in the direction of an exterior room, wherein the profile shell parts are connected to each other, thermally separated from each other via at least one insulating element (e.g. insulating profile, or web). Hereby, further improving the thermal separation between the two profile sides of the profile assembly. Furthermore, cost advantages can be achieved with the partially same profile structure of vertical and horizontal profile elements and the thus linked reduction of different parts.

Preferably furthermore, one respective guide channel is formed in each one of the two profile shell parts of the first profile element, which again benefits the stability of the profile assembly.

In particular, it is provided to dispose each fastening channel of the first profile element exclusively in the profile shell part designed for the interior room (respectively the cold side). In this way improving the ability for expansion of the entire frame element.

Advantageously, the at least one fastening channel is embodied as a screw channel—particularly preferred as a screw channel, in which, during first mounting, the thread is cut with the fastening means embodied as a screw.

Preferably, each insulating element comprises plastic material or composite material with plastic material components, which correspondingly guarantee optimized properties in terms of thermal separation.

Preferably, the profile connecter element is made from sheet steel and in particular has a thickness of at least 3 mm—particularly preferred a thickness of 4 mm.

With advantage, at least one leg part of the profile connecter element is formed such that starting at the free leg end thereof to be introduced into the guide channel of the first profile element, prior to reaching the base part, the leg part has a step-shaped widening, via which, in the mounted condition, the profile element partially props up at the frontal face. Said vertical steps, formed on both sides, in the contour of the free leg parts at the height of the contact plane of horizontal profile and vertical profile, form a defined locating edge of the profile connecter element (and thus of the free lateral walling edges of the U-shaped recess of the second profile element) at the frontal face of the first profile element (horizontal profile) and, furthermore guaranteeing the absorption of the generated tensile forces while simultaneously ensuring a gap-free transition of the profile elements in the joint area, or the link area. Preferably, the step splits in equal portions on both sides of the legs, so as to result in a symmetric shape of the connector element to a horizontal median plane (for a universal use right and left, or top and bottom). Hereby, the position of the step at the connector element with regard to the surface of a leg part resting in the vertical profile corresponds to the depth dimension of the glass reception channel in the vertical profile.

Preferably, the first profile element, disposed in the profile shell part thereof in the direction interior room, includes at least two fastening channels, wherein the second profile element is connected to the first profile element by means of two fastening means corresponding to the fastening channels via the connector element (with corresponding mounting openings in the base part), or is connectable to the first profile element via the connector element. Preferably, fixing the connector element is realized by means of screw connection/s through at least one profile walling (either in one of the aluminium shells, in the insulating element or in a combination of aluminium shell/s and insulating element) in the vertical profile. For this purpose, the concerned profile walling/s include the through-bores (mounting openings of the bottom-side profile walling of the U-shaped recess of the second profile element) corresponding to the positions of the fastening or screw channels in the horizontal profile as well as to the hole pattern (mounting openings) in the base part of the connector element. With advantage at least two mounting openings are provided in the second profile element, which correspond to two mounting openings in the profile connecter element, wherein, preferably, is disposed one of the mounting openings in the profile walling of the first profile shell part and another mounting opening partially in the profile walling of the first profile shell part and partially in the profile walling of the thermal separating element (namely so to say on the separation line between the profile of the first profile shell part and the separating element formed as a profile). It is likewise conceivable to form one of the mounting openings in the profile shell part and a further mounting opening in the profile of the separating element.

For distributing forces arising on account of the screw connection, preferably an intermediate plate is provided having mounting openings corresponding to the mounting openings of the second profile element, which, like a washer, prohibits too high a force input in the area of the at least one insulating web. With the thus reduced surface pressure of the screw heads, prohibiting subsequent "settling" in the contact area between screw head and (aluminium) profile. Particularly preferred, the intermediate plate is formed such that, in the mounted condition, it props up at both profile shell parts of the second profile element. Hereby achieving an optimized force distribution within the second profile element.

BRIEF DESCRIPTION OF THE DRAWINGS

Hereinafter, the profile assembly is explained in detail based on drawings. It shows diagrammatically.

DETAILED DESCRIPTION OF THE DRAWINGS

Figure 1A:
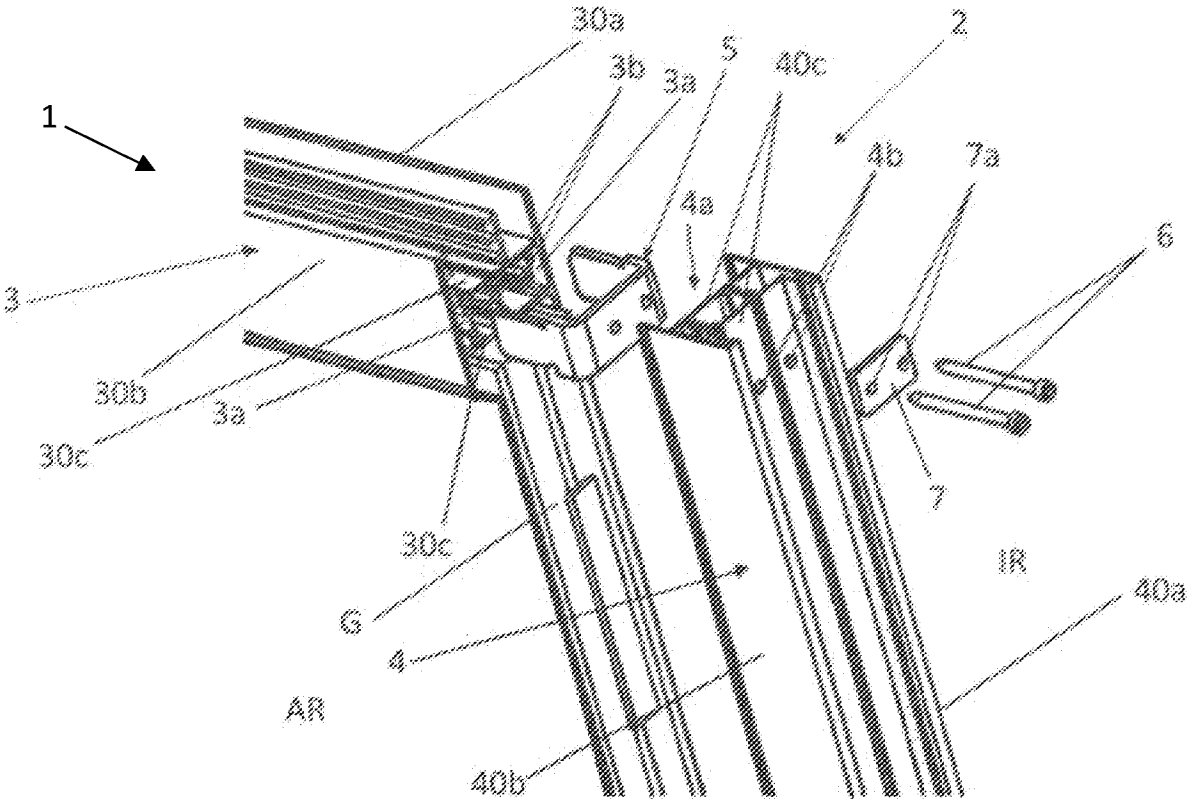
FIG. 1*a* a door element illustrated in details, with a profile assembly according to the disclosure in a perspective view as a partially exploded illustration, FIG. 1*b* a door element according to FIG. 1*a* in a slightly different perspective view, FIG. 2 a profile connecter element according to FIGS. 1*a* and 1*b* in an enlarged perspective individual illustration, FIG. 3 an enlarged partial view of the profile assembly illustrated in FIG. 1 in an exploded illustration, and FIG. 4 a partial view of the profile assembly illustrated in FIG. 1 in a mounted (connected) condition.
Figure 1B:
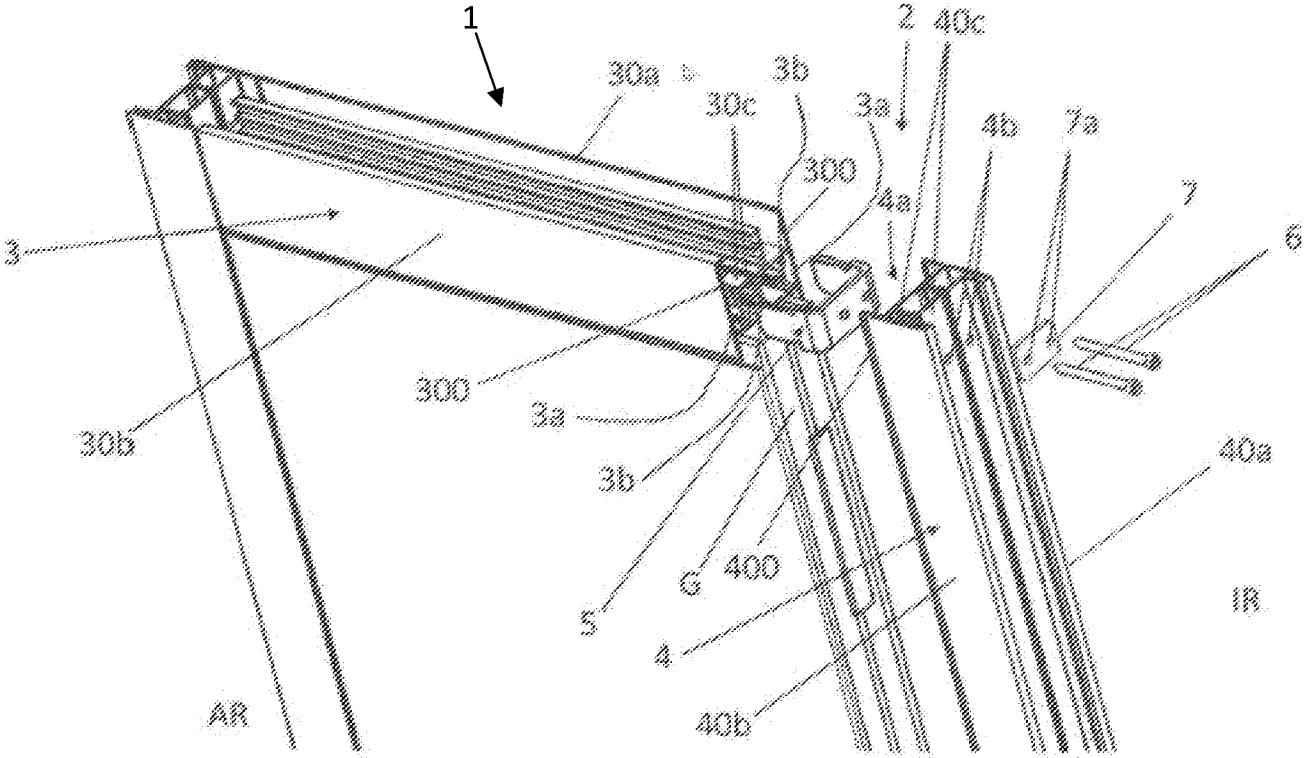
Figure 3:
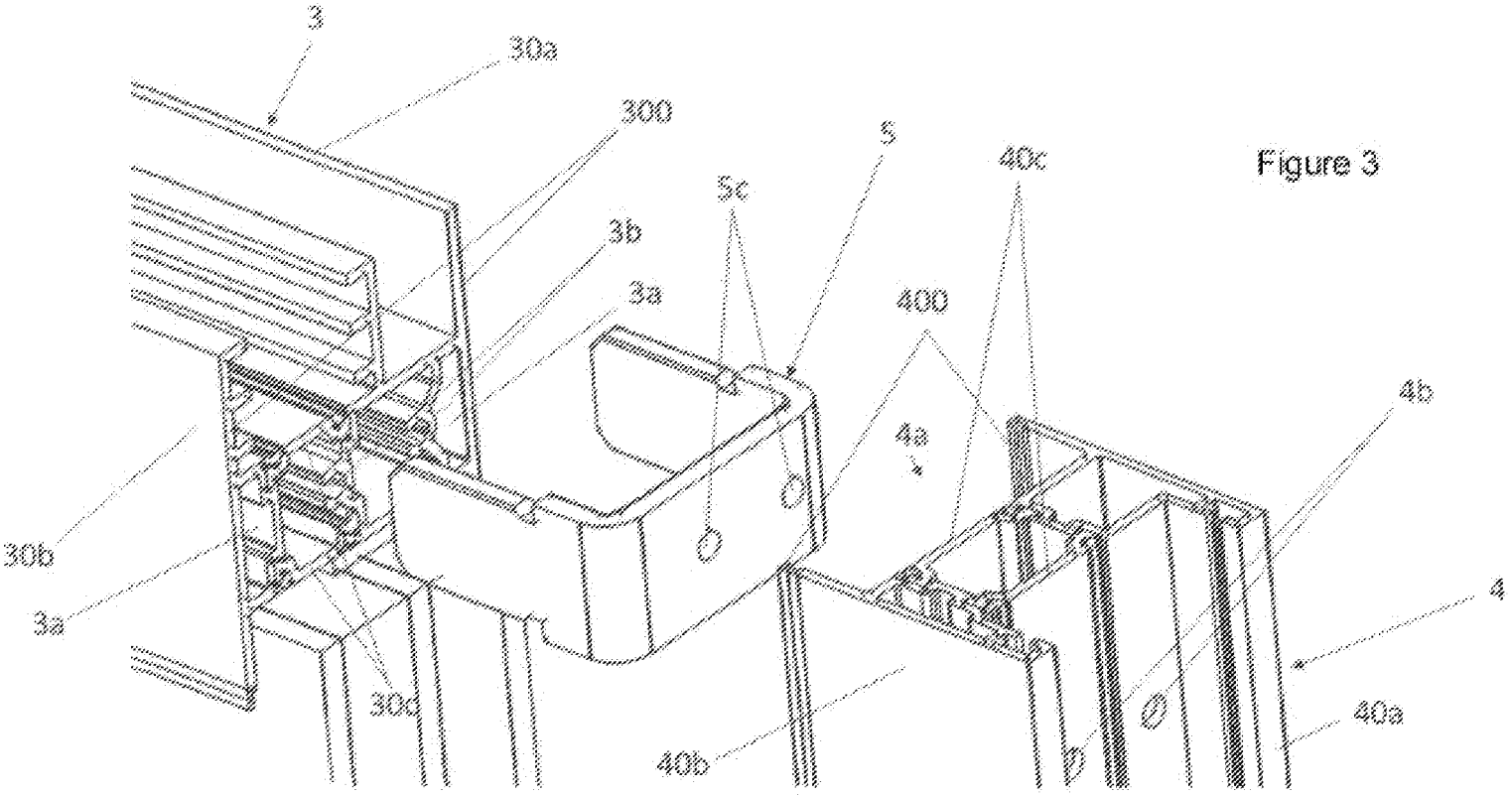
Figure 4:
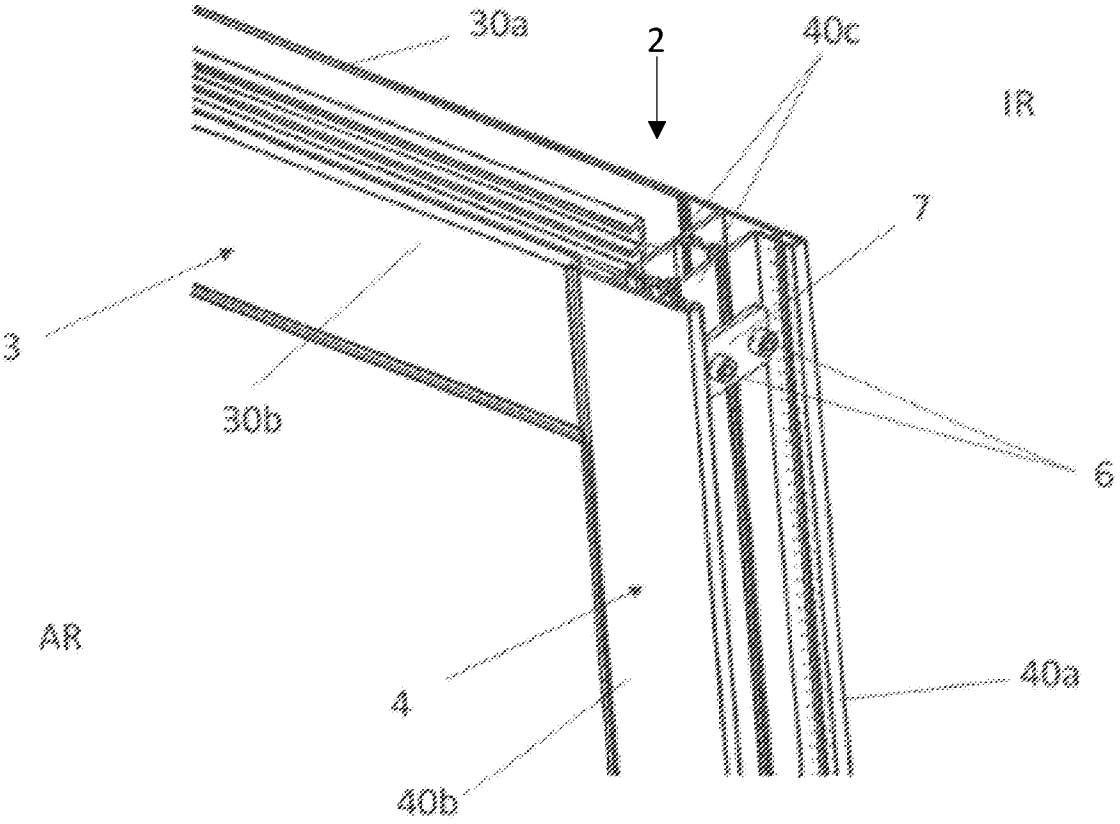

In the FIGS. 1*a* and 1*b*, as well as in the FIGS. 3 and 4, a door element 1 is illustrated in details, with a profile assembly 2 according to a possible embodiment of the disclosure (in a specified further development), which is shown in a perspective view in a partial exploded illustration. The profile assembly 2 comprises a first profile element 3 formed as a horizontal profile, a second profile element 4 formed as a vertical profile, a profile connecter element 5, which, seen in cross-section, is formed U-shaped and which has two leg parts 5*a* as well as a base part 5*b* connecting the two leg parts 5*a* at one end, as well as at least one fastening means 6, herein in the shape of a screw, for connecting to each other the two profile elements 3; 4 while using the profile connecter element 5.

Essentially, the door element 1 (illustrated in details) comprises a frame, which is formed from two horizontal profiles 3 and two vertical profiles 4 as well as a glass pane G received in the profiles and fitted in U-shaped recesses of the profile elements, and appropriate small parts and seals. In this case, the four connector corners of the door frame are formed preferably in the same way as described herein in FIG. 1 for one corner.

Extending in profile length direction, the first profile element 3 has guiding channels 3*a*, preferably for the positive reception of the two leg parts 5*a* of the profile connecter element 5. Furthermore, the first profile element 3 includes two fastening channels 3*b* for non-positively or positively receiving the at least one fastening means 6.

Seen in cross-section, the second profile element 4 has a U-shaped recess 4*a* for receiving the profile connecter element 5, wherein, in the base part 5*b* thereof, the profile connecter element 5 and, in the bottom of the U-shaped recess 4*a* thereof, the second profile element 4 have two mounting openings 4*b* corresponding to the fastening channels 3*b* of the first profile element 3, for passing the two fastening means 6 there through.

Figure 2:
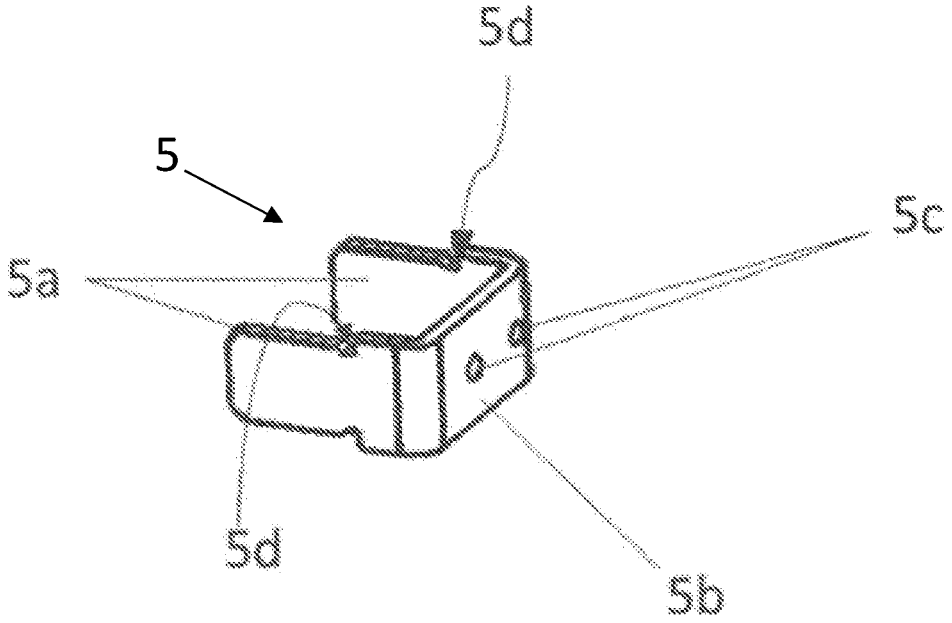

In the illustrated exemplary embodiment, preferably two screws are used as the fastening means 6, which passing through two mounting openings 4*b* of the second profile element 4 as well as through two mounting openings 5*c* corresponding thereto of the profile connecter element 5, are screwed in corresponding fastening channels 3*b* of the first profile element 3. Preferably, the profile connecter element 5 is manufactured from sheet steel having a thickness of approximately 4 mm, for guaranteeing, on the one hand, a simple manufacture by stamping and bending and, on the other hand, for having a sufficient strength for being able to carry corresponding profile and door element loads. For distributing screwing forces arsing in the screw connection of the profile elements 3; 4 and for prohibiting extreme punctual loads, is used an intermediate plate 7 having two mounting openings 7*a*, which like a washer is placed under the screw heads of the fastening means 6. With the intention to prevent to the largest possible extent edge tensions arising in the area (potential contact area) of the profile edges 300; 400 of the profile elements 3; 4 to be connected and to simultaneously guarantee an as gap-free as possible a connection of the same, at least one leg part 5*a* of the profile connecter element 5 is formed such that starting at the free leg end thereof to be introduced into the guide channel 3*a* of the first profile element 3, prior to reaching the base part 5*b*, the leg part 5*a* has a step-shaped widening 5*d* (see FIG. 2), via which, in the mounted condition, the first profile element 3 props up in areas on the front face.

Each profile element 3; 4 is formed in several parts and comprises at least one first profile shell part 30*a*; 40*a* disposed in the direction of an interior room IR, and a second profile shell part 30*b*; 40*b* disposed in the direction of an exterior room AR. The two profile shell parts 30*a*, 30*b*; 40*a*, 40*b* are connected to each other, yet thermally separated from each other via at least one insulating element 30*c*; 40*c* formed as an insulating web.

In this case, one respective guide channel 3*a* is formed in each one of the two profile shell parts 30*a*, 30*b* of the first profile element 3.

Via the insulating element 40*c* itself (for example the technical material and/or constructive structure, potentially in several parts), or via the linking of the insulating element 40*c* to one of the two connected profile shell parts 40*a*, 40*b*, a thrust-flexible connection is guaranteed in the second profile element 4 between the profile shell part 40*a* disposed in the direction interior room IR and the profile shell part 40*b* disposed in the direction exterior room AR. According to this disclosure, a thrust-flexible connection is understood in that a relative displaceability is guaranteed in that already when using a medium manual force, with which, when acting on the profile shell parts, which are to be displaced in relation to each other, they can be displaced opposite each other.

For guaranteeing the relative displaceability between insulating element 40*c* and one of the profile shell parts 40*a*, 40*b*, each provided fastening channel 3*b* of the first profile element 3 is disposed in the profile shell part 30*a* designed for the interior room IR (respectively disposed in the direction thereof).

In the illustrated exemplary embodiment with two fastening means 6—of which one fastening means 6 is affixed through a mounting opening 4*b* in the insulating element 40*c* of the second profile element 4 in a fastening channel 3*b* corresponding thereto of the profile shell part 30*a*, disposed in the direction interior room IR, of the first profile element 3, —the relative mobility must be formed between the insulating element 40*c* and the profile shell part 40*b*, oriented in the direction exterior room AR, of the second profile element 4.

In FIG. 4, the profile assembly 2 is illustrated in a mounted or screwed condition, with a horizontal profile 4 and a vertical profile 3, which form a frame corner of a door element 1.

It is understood that the reference to the interior room and exterior room is made to the temperature conditions in or at the profile shell parts (which are "associated" to the exterior or interior room) and, as an alternative, one could speak instead of exterior room (exterior profile side exposed to the sun) also of the warm profile side and instead of interior room of cold profile side, as it is question of the temperature compensation between two very differently tempered profile shells, one being considerably warmer (e.g. from UV-rays or sun exposure) than then other one, and this is why the profile elements or the profile shell parts thereof can experience corresponding expansions.

The invention claimed is:

1. A profile assembly for door systems for separating an interior room from an exterior room, the profile element comprising:

a first profile element formed as a horizontal profile;

a second profile element formed as a vertical profile;

a profile connecter element formed U-shaped and having two leg parts and a base part connecting the two leg parts at one end; and at least one fastening means configured to connect the two profile elements to each other while using the profile connecter element, the first profile element having guide channels extending in profile length direction for receiving the two leg parts of the profile connecter element, wherein the first profile element includes at least one fastening channel for non-positively or positively receiving the at least one fastening means, wherein, seen in cross-section, the second profile element has a U-shaped recess for receiving areas of the profile connecter element and the profile connecter element, in the base part thereof, and the second profile element, in the bottom of the U-shaped recess thereof, include at least one mounting opening corresponding to the fastening channel of the first profile element for passing the fastening means therethrough, wherein at least the second profile element is formed in several parts and includes at least one first profile shell part disposed in the direction of an interior room and a second profile shell part disposed in the direction of an exterior room, wherein the profile shell parts are connected to each other, yet thermally separated from each other via at least one insulating element, and wherein at least in the second profile element, via the insulating element itself or via the link of the insulating element to one of the two connected profile shell parts, there is a thrust-flexible connection between the profile shell part disposed in the direction interior room and the profile shell part disposed in the direction exterior room, whereby there is a relative displaceability in profile length direction between the two profile shell parts of the second profile element.

2. The profile assembly according to claim 1, wherein the first profile element is formed in several parts and includes at least one first profile shell part disposed in the direction of an interior room and a second profile shell part disposed in the direction of an exterior room, wherein the profile shell parts are connected to each other, yet thermally insulated from each other via at least one insulating element.

3. The profile assembly according to claim 2, wherein each fastening channel of the first profile element is disposed in the profile shell part configured for the interior room.

4. The profile assembly according to claim 2, wherein one respective guide channel is formed in each one of the two profile shell parts of the first profile element.

5. The profile assembly according to claim 1, wherein the at least one fastening channel is embodied as a screw channel, in which during first mounting, the thread is cut with the fastening means embodied as a screw.

6. The profile assembly according to claim 1, wherein at least one leg part of the profile connecter element is formed such that starting at the free leg end thereof to be introduced into the guide channel of the first profile element, prior to reaching the base part, the leg part has a step-shaped widening, via which in the mounted condition, the first profile element supports the frontal face.

7. The profile assembly according to claim 1, wherein the first profile element includes at least two fastening channels in the profile shell part disposed in the direction interior room and the second profile element is connected to the first profile element with two fastening means corresponding to the fastening channels.

8. The profile assembly according to claim 1, wherein at least two mounting openings are provided in the second profile element (4), which correspond to two mounting openings in the profile connecter element and wherein one of the mounting openings is fitted in the at least one insulating element.

9. The profile assembly according to claim 8, wherein an intermediate plate is provided having the mounting openings corresponding to the mounting openings of the second profile element, which plate prohibits a force effect in the area of the at least one insulating element and guarantees corresponding force distribution and is configured such that, in the mounted condition, the intermediate plate supports the two profile shell parts of the second profile element.

10. A door element with a profile assembly according to claim 1.

* * * * *